US006136493A

United States Patent [19]

Fujiwara et al.

[11] Patent Number: 6,136,493

[45] Date of Patent: Oct. 24, 2000

[54] LIQUID DEVELOPER SET, CONCENTRATED LIQUID DEVELOPER, DILUENT AND METHOD OF MANUFACTURING THE DILUENT

[75] Inventors: Toshimitsu Fujiwara, Osaka; Hidetoshi Miyamoto, Takatsuki; Keyaki Yogome, Kyoto, all of Japan

[73] Assignee: Minolta Co., Ltd., Osaka, Japan

[21] Appl. No.: 09/376,013

[22] Filed: Aug. 18, 1999

[30] Foreign Application Priority Data

Aug. 20, 1998 [JP] Japan ..... 10-234606

[51] Int. Cl.[7] ..... G03G 9/135

[52] U.S. Cl. ..... 430/116; 430/137

[58] Field of Search ..... 430/106, 109, 430/137, 116, 117

[56] References Cited

U.S. PATENT DOCUMENTS

| | | | |
|---|---|---|---|
| 4,794,651 | 12/1988 | Landa et al. | 430/110 |
| 4,860,924 | 8/1989 | Simms et al. | 222/56 |
| 5,047,307 | 9/1991 | Landa et al. | 430/137 |
| 5,192,638 | 3/1993 | Landa et al. | 430/137 |
| 5,492,788 | 2/1996 | Denton et al. | 430/137 |
| 5,780,196 | 7/1998 | Fujiwara et al. | 430/137 |
| 5,843,613 | 12/1998 | Fujiwara et al. | 430/114 |
| 5,963,758 | 10/1999 | Corn et al. | 430/117 |

*Primary Examiner*—John Goodrow

*Attorney, Agent, or Firm*—Burns, Doane, Swecker & Mathis, LLP

[57] ABSTRACT

A liquid developer set formed of a liquid developer used for developing an electrostatic latent image and containing a carrier liquid, a charge director and toner, a first liquid, which is obtained by removing a solid component from the liquid developer, having a charge director concentration C1 and a conductivity E1; a concentrated liquid developer containing the carrier liquid, the charge director and the toner in a higher concentration than the toner concentration of the liquid developer, a second liquid, which is obtained by removing a solid component from the concentrated liquid developer, having a charge director concentration C2 and a conductivity E2 substantially equal to the concentration C1 and the conductivity E1, respectively; and a diluent containing the carrier liquid and the charge director, and having a charge director concentration C3 and a conductivity E3 substantially equal to the concentration C1 and the conductivity E1, respectively. The concentrated liquid developer, the diluent and a method of manufacturing the diluent.

20 Claims, 2 Drawing Sheets

LIQUID DEVELOPER SET, CONCENTRATED LIQUID DEVELOPER, DILUENT AND METHOD OF MANUFACTURING THE DILUENT

The invention is based on patent application No. 10-234606 Pat. filed in Japan, the contents of which are hereby incorporated by reference.

BACKGROUND OF THE INVENTION

1. Field of the Invention

The present invention relates to a liquid developer set which is used for developing an electrostatic latent image with a liquid developer in an electrophotographic image forming device such as a copying machine or a printer, and is formed of the liquid developer as well as a concentrated liquid developer and a diluent to be supplied to the liquid developer. Further, the invention relates to the concentrated liquid developer to be supplied or added, a diluent to be supplied or added, and a method of manufacturing the diluent.

2. Description of the Background Art

For electrophotographic image formation, an electrostatic latent image is generally formed, e.g., by effecting image exposure on an electrostatic latent image carrier such as a photosensitive member in accordance with image information, and then is developed into a visible toner image, which is transferred and fixed onto a record member for providing an intended image.

The developing method in the electrophotographic image formation can be classified into a dry developing type and a wet developing type.

In the dry developing method, the developer is formed of toner or a mixture of toner and carrier having, e.g., magnetism. Usually, the dry toner includes, as its major components, a pigment and binder resin, and may also include a charge director, a conductivity control agent, a plasticizer and/or a releasing agent and others which are internally or externally added thereto, if necessary. Further, the magnetic toner includes magnetic powder such as magnetite ($Fe_3O_4$). In the dry developing method, the toner is usually charged by contact with a specific surface of a developing device and/or mutual contact between toner particles. In the case of two-component developer including carrier, the toner is usually charged by contact with the carrier or the like. Further, charging may be performed, e.g., by electrostatic induction by an electric field, implantation of charges, and/or ion absorption caused by ionizing and discharging of air or the like. The toner thus charged is transferred onto an electrostatic latent image carrying portion of an electrostatic latent image carrier such as a photosensitive member by an electrostatic force, a mechanical force, a magnetic force or the like, and is used for development by an electrostatic force.

Since dry toner and others used for the dry development may escape into and float in an ambient atmosphere, diameters of them can be reduced only to a restricted extent, and is usually in a range from about 5 $\mu$m to about 10 $\mu$m. Since the dry toner has a relatively large diameter, a high image density can be easily achieved.

Meanwhile, the developer, which is currently mainstream in the wet developing method, includes an electrically insulating dispersant medium (carrier liquid), and also includes the toner for development (typically, coloring fine particles primarily formed of a pigment and binder resin), a charge director, a dispersion stabilizing agent and others which are dispersed in the dispersant medium. It is considered that the toner in the wet developing system is charged owing to ion absorption by virtue of the charge director, and the charged toner electrically migrates in the carrier liquid owing to the electric field applied to the liquid developer, and is transported onto the electrostatic latent image carrier for use in development.

Since there is no possibility that the toner used in the wet development escapes into the atmosphere, fine toner can be used, and it usually has an average diameter of about 5 $\mu$m or less. Thereby, the produced image can have a high resolution and a good gray scale property. Also, advantages such as easy fixing of the toner image can be achieved.

The toner in the liquid developer exists as particles, of which surfaces are charged to have a certain polarity by virtue of the charge director. It can be considered that ions of the charge director or ions produced by reaction of the charge director with the toner are present as counter ions having the polarity opposite to that of the toner. Accordingly, the toner is usually charged to a higher extent as the amount of the charge director added to the carrier liquid increases. By applying a voltage to the liquid developer, the charged toner and the counter ions in the carrier liquid electrically migrate in the opposite directions, respectively. The development is performed by utilizing this phenomenon (electrophoresis).

According to the study by the inventors, it is already known that all the charge director added to the liquid developer is not absorbed to and reacted with the toner to contribute charging of the toner. A large part of the added charge director is present in the carrier liquid. This can be confirmed by the following experiment. Hydrocarbon solvent of a high resistance of about $10^{14}$ $\Omega$·cm is used as the carrier liquid, and the liquid developer prepared by adding the toner and the charge director to this solvent is processed to separate the toner and the liquid component from each other by centrifugal separation. When an electric resistance of the liquid component thus separated is measured, it usually exhibits a value smaller than $10^{14}$ $\Omega$·cm.

With increase in amount of the added charge director, therefore, the amount of the charge director absorbed to and reacted with the toner increases, and the amount of the free charge director existing in the carrier liquid also increases so that the electric resistance of the carrier liquid lowers. As already described, development of the electrostatic latent image on the electrostatic latent image carrier is developed with the liquid developer in such a manner that the charged toner electrically migrates in the carrier liquid owing to the electric field applied to the liquid developer, and electrostatically adheres onto the electrostatic latent image carrying portion. In this operation, if a large amount of free charge director is present in the carrier liquid, the free charge director acts to erase the electrostatic latent image so that image flow (blurring) occurs and/or image density lowers.

In the image forming apparatus using the liquid developer, a predetermined space is formed between the electrostatic latent image carrier carrying the electrostatic latent image and a developing electrode for development, and the liquid developer is supplied into this space. When the voltage is applied across the electrostatic latent image carrier and the developing electrode, the charged toner electrically migrates in the carrier liquid, and is absorbed onto the electrostatic latent image carrier, and free charge director is left in the carrier liquid. Accordingly, the free charge director is condensed in the liquid developer when the development is repeated.

Since the toner in the liquid developer is consumed, the toner must be supplied or added. For supply of the toner, the device uses a concentrated liquid developer (which may also be referred to as a "concentrated liquid" hereinafter) having a toner concentration which is about 10 times larger than that of the liquid developer used for usual development, and thereby a constant toner concentration is kept in the liquid developer used for the development.

For manufacturing the liquid developer in the prior art, such a method is employed in view of the manufacturing cost and the easy handling that the concentrated liquid is first prepared, and then is diluted with the carrier liquid. Accordingly, the concentrated liquid contains the charge director in higher concentration than the predetermined concentration of the charge director in the liquid developer used for the development.

For performing the image formation while supplying the concentrated liquid to the liquid developer, the concentrated liquid is first diluted with an organic solvent formed of the carrier liquid, and the diluted liquid is used as an initial developer or starter. When the image density lowers, the concentrated liquid is supplied. When the amount of the liquid component of the liquid dwveloper decreases, the carrier liquid is supplied. According to this method, the toner concentration can be kept constant, but the charge director is accumulated in the liquid developer used for the development. When only the concentration of the charge director increases while the toner concentration is constant, an amount of charges of the toner usually increases excessively, or an electrical resistance of the carrier liquid usually lowers excessively. In either case, the density of the final image extremely lowers when the image formation is repeated many times.

As a supply method which can suppress the above phenomenon, U.S. Pat. No. 4,860,924 and others have disclosed a method, in which the concentration of the charge director in the concentrated liquid is lower than a conventional value, and an independent carrier liquid solution of the charge director is used for supplying the charge director. In this method, a predetermined voltage is applied to the liquid developer used for the development, and a current flowing therethrough is detected. Based on the detected current value, the concentrated liquid and the carrier liquid solution of the charge director are supplied independently of each other so as to keep the current at a constant value. According to U.S. Pat. No. 4,860,924 and others, the current kept at the constant value flows through the liquid developer so that change in image density can be suppressed.

However, even if the value of the current flowing through the liquid developer is kept constant according to the method taught by U.S. Pat. No. 4,860,924 and others, the image density gradually changes in a practical operation when the concentrated liquid and the carrier liquid solution of the charge director are supplied.

SUMMARY OF THE INVENTION

Accordingly, an object of the invention is to provide a liquid developer set, which is used for development of an electrostatic latent image with a liquid developer in an electrophotographic image formation, and is formed of the liquid developer, a concentrated liquid developer and a diluent. More specifically, an object of the invention is to provide a liquid developer set, which can provide final images kept at a predetermined density even when image formation is repeated and the concentrated liquid developer and the diluent are supplied as supply liquids to the liquid developer for controlling a toner concentration and a liquid amount of the liquid developer used for the development.

Another object of the invention is to provide a concentrated liquid developer and a diluent, which are supplied for controlling a toner concentration and a liquid amount of a liquid developer used for development in electrophotographic image formation, and more specifically, a concentrated liquid developer and a diluent, which can keep a predetermined density of final images even when image formation is repeated while supplying the concentrated liquid developer and the diluent.

A further object of the invention is to provide a diluent manufacturing method which allows efficient manufacturing of such a diluent.

For achieving the above objects, the inventors have made studies, and obtained the following knowledge.

Even if a value of current flowing through the liquid developer used for the development is kept constant, the image density gradually changes due to supply of the concentrated liquid and the carrier liquid solution (diluent) of the charge director as described before. This is because the amount of charges of the toner gradually changes. The change in charge amount of the toner is caused because, in some states of the charge director in the supply liquid, the value of current which flows through the liquid developer when a predetermined voltage is applied thereto does not necessarily correspond to the concentration of the charge director used for applying charges to the toner. Accordingly, the foregoing disadvantages can be prevented by employing the concentrated liquid and the diluent which can provide the same charge director concentration and the same current value under application of a predetermined voltage as those in the liquid developer used for the development.

In a solution formed of the carrier liquid and the charge director dissolved therein, the concentration of the charge director is generally in proportion to the value of current flowing through the solution. However, in the process of manufacturing the liquid developer, the charge director which is initially added in the manufacturing process has characteristics such as electric characteristics, which significantly change in accordance with steps. The reason for this is as follows. In the process of manufacturing the liquid developer, a mixture of binder resin, a coloring agent and others is crushed in the carrier liquid containing the charge director dissolved therein. Thereby, the toner particles, charge director and others are dispersed in the carrier liquid. In the step(s), various stresses such as a thermal stress and a mechanical stress are applied to the charge director. For the above reason, the above change occurs.

The above can be confirmed by the following experiment. The concentration of the charge director dissolved in the hydrocarbon solvent can be measured by an ultraviolet/visible ray absorption spectrum measuring device (UV-VIS). For example, barium salt of petroleum sulfonic acid which is generally used as the charge director has a peak at or around the wavelength of 325.5 nm. In the solution containing the barium salt of petroleum sulfonic acid dissolved in the hydrocarbon solvent, the concentration of the petroleum sulfonic acid barium salt and the absorbance at 325.5 nm are in proportion to each other as shown in FIG. 1.

The peak position (wavelength) does not change even when various stresses are applied to the charge director. For example, even if this solution is processed with a bead mill using glass beads, and thereby is subjected to mixing, stirring and strong shearing, the peak position (wavelength)

does not change. Likewise, the bead mill processing does not change the relationship between the concentration of petroleum sulfonic acid barium salt and the absorbance at 32.5 nm, and the same result as that shown in FIG. 1 can be achieved.

However, the value of current, which flows when a predetermined voltage is applied to the solution containing the petroleum sulfonic acid barium salt dissolved in the solvent, changes between the points of time before and after the bead mill processing. FIG. 2 shows a relationship between the concentrations of petroleum sulfonic acid barium salt in these two solutions and the value of current which flows when a predetermined voltage is applied.

The value of current which flows when a predetermined voltage is applied to the solution is represented in terms of the amount of charges which move when each solution of 0.2 ml is set in a charge amount measuring device shown in FIG. 3 and a constant voltage of 500 V is applied for 10 msec.

The device shown in FIG. 3 is formed of a roller-like electrode R which has a substantially cylindrical form of 30 mm in diameter, has closed opposite ends and is made of stainless steel, an opposed electrode E which extends along the outer periphery of the roller-like electrode R and covers the substantially half the outer peripheral surface thereof, a coulomb meter C connected in series between the roller-like electrode R and the opposed electrode E, and a bias power source PS. The bias power source PS can apply a constant voltage across the opposed electrode E serving as a negative electrode and the roller-like electrode R serving as a positive electrode. A gap of 300 $\mu$m is present between the roller-like electrode R and the opposed electrode E.

For measuring the amount of charges in the solution of the petroleum sulfonic acid barium salt by the above device, 0.2 ml of the solution is supplied into the gap between the roller-like electrode R and the opposed electrode E, and the power source PS applies a constant voltage of 500 V across the roller-like electrode R and the opposed electrode E for 10 msec. The electric field in this state goes to $1.67\times10^6$ V/m. The amount of charges which move in this state is measured by the coulomb meter C. The charge amount thus measured corresponds to the amount of charges which flow during movement of the petroleum sulfonic acid barium salt (i.e., the charge director) in the solution.

As shown in FIG. 2, a proportionality is present between the concentration of the charge director and the amount of moved charges regardless of execution and nonexecution of the bead mill processing. However, the charges moving in the solution which was subjected to the bead mill processing are smaller in amount than those in the solution, which contains the charge director in the same concentration but was not subjected to the bead mill processing.

Although the reason why application of the stress to the charge director solution reduces the amount of moving charges is not specifically clear, this reduction is probably caused by the fact that the portion applying the charges to the toner and the portion, which moves in itself to cause the current flow (ionic dissociation), are present independently of each other in the molecules of the charge director, and the applied stress changes the characteristics of only the portion causing the current flow.

From the above, in the operation of supplying the concentrated liquid and the diluent to the liquid developer used for the development, it is necessary to keep the charge director in the constant concentration in addition to keeping of the current flowing through the liquid developer at a constant value in order to keep the predetermined image density. For this, it is required that the liquid component prepared by removing the toner from the liquid developer used for development as well as the liquid component prepared by removing the toner from the concentrated liquid and the diluent have the equal charge director concentration and the equal conductivity. Further, it can be understood that these are required to be prepared by applying equal stresses, respectively.

Based on the above knowledge, the invention provides the following liquid developer set, concentrated liquid developer and diluent as well as a method of manufacturing the diluent.

(1) Liquid Developer Set

A liquid developer set formed of a liquid developer used for development of an electrostatic latent image as well as a concentrated liquid developer and a diluent to be supplied to the liquid developer, and including:

the liquid developer for development containing a carrier liquid, a charge director and toner, a first liquid, which is obtained by removing a solid component from the liquid developer, having a charge director concentration C1 and a conductivity E1;

the concentrated liquid developer containing the carrier liquid, the charge director and the toner in a higher concentration than the toner concentration of the liquid developer, a second liquid, which is obtained by removing a solid component from the concentrated liquid developer, having a charge director concentration C2 and a conductivity E2 substantially equal to the charge director concentration C1 and the conductivity E1 of the first liquid, respectively; and the diluent containing the carrier liquid and the charge director, and having a charge director concentration C3 and a conductivity E3 substantially equal to the charge director concentration C1 and the conductivity E1 of the first liquid, respectively.

(2) Concentrated Liquid Developer

A concentrated liquid developer to be supplied to a liquid developer used for development of an electrostatic latent image and containing a carrier liquid, a charge director and toner, comprising:

the carrier liquid, the charge director and the toner in a concentration higher than that of the toner in the liquid developer for development, a second liquid, which is prepared by removing a solid component from the concentrated liquid developer, having a charge director concentration C2 and a conductivity E2 substantially equal to a charge director concentration C1 and a conductivity E1 of a first liquid obtained by removing a solid component from the liquid developer for development, respectively.

(3) Diluent

A diluent to be supplied to a liquid developer used for development of an electrostatic latent image and containing a carrier liquid, a charge director and toner, comprising:

the carrier liquid and the charge director, the diluent having a charge director concentration C3 and a conductivity E3 substantially equal to a charge director concentration C1 and a conductivity E1 of a first liquid obtained by removing a solid component from the liquid developer for development, respectively.

(4) Method of Manufacturing a Diluent (4-1) A method of manufacturing a diluent to be supplied to a liquid developer used for development of an electrostatic latent image and containing a carrier liquid, a charge director and toner, including the steps of:

preparing a toner-dispersed liquid containing the carrier liquid, the charge director and the toner; and obtaining the diluent by removing a solid component from the toner-dispersed liquid.

(4-2) A method of manufacturing a diluent to be supplied to a liquid developer used for development of an electrostatic latent image and containing a carrier liquid, a charge director and toner, comprising the steps of:

preparing a carrier liquid having a charge director concentration substantially equal to that of a first liquid obtained by removing a solid component from the liquid developer for development; and adjusting a conductivity of the carrier liquid to be substantially equal to that of the first liquid by applying a predetermined stress to the carrier liquid.

(4-3) A method of manufacturing a diluent to be supplied to a liquid developer used for development of an electrostatic latent image and containing a carrier liquid, a charge director and toner, including the steps of:

preparing a carrier liquid having a charge director concentration substantially equal to that of a first liquid obtained by removing a solid component from the liquid developer for development; and adjusting a conductivity of the carrier liquid to be substantially equal to that of the first liquid by applying a shearing force to the carrier liquid while mixing beads with the carrier liquid.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
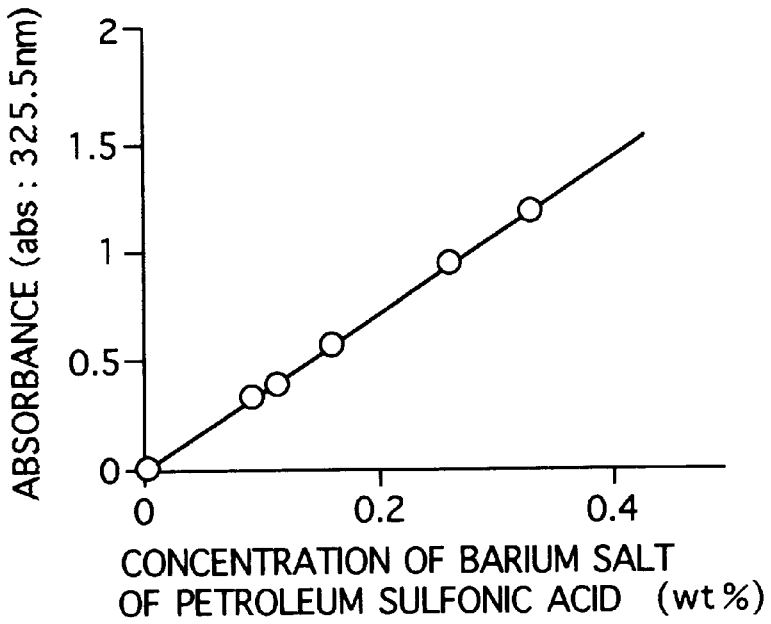
FIG. 1 shows a relationship between a concentration of barium salt of petroleum sulfonic acid and an absorbance at 325.5 nm.

A liquid developer set of an embodiment of the invention includes a liquid developer used for developing an electrostatic latent image as well as a concentrated liquid developer and a diluent to be supplied to the liquid developer.

More specifically, the liquid developer set includes:

the liquid developer containing a carrier liquid, a charge director and toner, a first liquid, which is obtained by removing a solid component from the liquid developer, having a charge director concentration C1 and an electric conductivity E1;

the concentrated liquid developer containing the carrier liquid, the charge director and the toner in a higher concentration than the toner concentration of the liquid developer, a second liquid, which is obtained by removing a solid component from the concentrated liquid developer, having a charge director concentration C2 and an electric conductivity E2 substantially equal to the charge director concentration C1 and the conductivity E1 of the first liquid, respectively; and the diluent containing the carrier liquid and the charge director, and having a charge director concentration C3 and an elctric conductivity E3 substantially equal to the charge director concentration C1 and the conductivity E1 of the first liquid, respectively.

In an operation of developing an electrostatic latent image with the foregoing liquid developer set, the concentrated liquid developer and/or the diluent are supplied to the liquid developer in accordance with a predetermined state of the liquid developer used for the development. For example, when the toner concentration of the liquid developer used for the development is lower than a predetermined concentration, the concentrated liquid developer is supplied. When the toner concentration is higher than the predetermined concentration or the amount of liquid is reduced, the diluent is supplied. By adjusting the amount of liquid or diluent thus supplied, the toner concentration of the liquid developer used for the development is kept constant, and the liquid amount allowing the development is maintained.

According to the liquid developer set described above, each of the liquid component of the concentrated liquid developer and the diluent to be supplied has the electric conductivity and the charge director concentration which are substantially equal to those of the liquid component of the liquid developer used for the development, respectively. Therefore, supply of them does not substantially change the conductivity and the charge director concentration of the liquid component of the liquid developer. Accordingly, even when image formation is repeated while supplying the foregoing liquid and diluent, the amount of charges of the toner and the amount of charges of the carrier liquid used for the development are kept constant so that the image density is kept constant.

The first liquid obtained by removing the solid component from the liquid developer used for development, the second liquid obtained by removing the solid component from the concentrated liquid developer and the diluent preferably have the charge director concentrations, each of which is equal to or differs by ±10% or less from an average of these three concentrations.

The first liquid obtained by removing the solid component from the liquid developer used for development, the second liquid obtained by removing the solid component from the concentrated liquid developer and the diluent preferably have the conductivities, each of which is equal to or differs by ±10% or less from an average of these three conductivities.

Particularly, it is preferable that the liquid developer used for development of the electrostatic latent image has the charge director concentration C1 being equal to or differing by ±10% or less from the average value of the three charge director concentrations C1, C2 and C3, and also has the conductivity E1 being equal to or differing by ±10% or less from the average value of the three conductivities E1, E2 and E3.

The toner may have a volume average particle diameter in a range from 0.1 $\mu$m to 10 $\mu$m.

The carrier liquid may have an electric resistance value in a range from $10^{11}$ Ω·cm to $10^{16}$ Ω·cm.

The diluent may be the second liquid obtained by removing a solid component from the concentrated liquid developer. In this case, the liquid developer for development may be a liquid developer prepared by diluting the concentrated liquid developer with the second liquid.

The diluent may be formed of a third liquid prepared by applying a predetermined stress to the carrier liquid having the substantially same charge director concentration as the second liquid, and thereby having the substantially same conductivity as the second liquid, and the liquid developer may be prepared by diluting the concentrated liquid developer with the third liquid.

A concentrated liquid developer of an embodiment of the invention is a supply developer which is to be supplied to a liquid developer for development and containing a carrier liquid, a charge director and toner.

The concentrated liquid developer contains the carrier liquid, the charge director and the toner in a concentration higher than that of the toner in the liquid developer for development. A second liquid prepared by removing a solid component from the concentrated liquid developer has a charge director concentration C2 and a conductivity E2 substantially equal to a charge director concentration C1 and a conductivity E1 of a first liquid obtained by removing a solid component from the liquid developer for development.

In the concentrated liquid developer, it is preferable that the charge director concentration C1 is equal to or differs by ±10% or less from an average value of the charge director concentration C1 and the charge director concentration C2, and the conductivity E1 is equal to or differs by ±10% or less from an average value of the conductivity E1 and the conductivity E2.

Similarly to the liquid developer set, the toner may have a volume average particle diameter in a range from 0.1 μm to 10 μm, and the carrier liquid may have an electric resistance value in a range from $10^{11}$ Ω·cm to $10^{16}$ Ω·cm.

A diluent of an embodiment of the invention is a supply liquid which is to be supplied to a liquid developer for development and containing a carrier liquid, a charge director and toner.

The diluent contains the carrier liquid and the charge director, and has a charge director concentration C3 and a conductivity E3 substantially equal to a charge director concentration C1 and a conductivity E1 of a first liquid obtained by removing a solid component from the liquid developer for development, respectively.

In the diluent, it is preferable that the charge director concentration C1 is equal to or differs by ±10% or less from an average value of the charge director concentration C1 and the charge director concentration C3, and the conductivity E1 is equal to or differs by ±10% or less from an average value of the conductivity E1 and the conductivity E3.

Similarly to the liquid developer set, the toner to be used together with the diluent may have a volume average particle diameter in a range from 0.1 pμm to 10 μm, and the carrier liquid may have an electric resistance value in a range from $10^{11}$ Ω·cm to $10^{16}$ Ω·cm.

The diluent may be a first liquid obtained by removing a solid component from the liquid developer for development.

The diluent may be a liquid obtained by preparing a carrier liquid having a charge director concentration substantially equal to that of a first liquid obtained by removing a solid component from the liquid developer for development, and thereby adjusting a conductivity of the carrier liquid to be substantially equal to that of the first liquid by applying a predetermined stress to the carrier liquid. In the latter diluent, the liquid developer may be prepared by diluting a concentrated liquid developer containing a carrier liquid, a charge director and toner in a higher concentration than the toner concentration of the liquid developer with the above diluent.

A method of manufacturing a diluent according to an embodiment of the invention is a method of manufacturing a diluent to be supplied to a liquid developer for development and containing a carrier liquid, a charge director and toner, and may be specifically one of the following methods (a), (b) and (c).

(a) The diluent manufacturing method includes the steps of:

preparing a toner-dispersed liquid containing the carrier liquid, the charge director and the toner; and obtaining the diluent by removing a solid component from the toner-dispersed liquid.

In this manufacturing method, the toner-dispersed liquid may be a concentrated liquid developer used as a supply liquid for the liquid developer for development.

(b) The method includes the steps of:

preparing a carrier liquid having a charge director concentration substantially equal to that of a first liquid obtained by removing a solid component from the liquid developer for development; and adjusting a conductivity of the carrier liquid to be substantially equal to that of the first liquid by applying a predetermined stress to the carrier liquid.

(c) The method includes the steps of:

preparing a carrier liquid having a charge director concentration substantially equal to that of a first liquid obtained by removing a solid component from the liquid developer for development; and adjusting a conductivity of the carrier liquid to be substantially equal to that of the first liquid by applying a shearing force to the carrier liquid while mixing beads with the carrier liquid.

Description will now be given on the liquid developer set and others in greater detail.

The concentrated liquid developer (which will also be referred to as the "concentrated liquid" hereinafter) and the diluent may be selected from combinations of the concentrated liquid developer and the diluent as well as the liquid developer manufactured in the following manner.

(1) Combination 1

First, a toner-dispersed liquid including toner, which is dispersed in a carrier liquid including a charge director, is first prepared.

The toner may be formed of pigment particles themselves. Alternatively, the toner may be fine coloring resin particles formed of a mixture of binder resin, a coloring agent such as a pigment or dye and, if necessary, various additives such as wax. The latter toner can be manufactured in the same method as conventional toner manufacturing methods in view of the kind of the binder resin to be used as well as the particle diameter, shape and others of the toner. Such toner manufacturing methods can be roughly classified into the dry manufacturing method and the wet manufacturing method. The dry manufacturing method includes a dry crushing method and others. The wet manufacturing method includes a wet crushing method, a suspension polymerization method, an emulsion polymerization method, a non-aqueous dispersion polymerization method, a seed polymerization method, an interface polymerization method, a spray drying method (spray granulation method), an emulsion dispersion granulation method and others.

In particular, the wet crushing method is preferable. According to the wet crushing method, the colored binder resin is roughly crushed into particles having a particle diameter smaller than about 1 mm, and the rough toner particles thus obtained are finely crushed in a liquid having a high electric resistance to produce the toner of an intended particle diameter.

More specifically, the binder resin, coloring agent and others are kneaded with a kneader provided with, e.g., three rolls, and thereby the coloring agent and others are dispersed in the resin.

The coloring agent may be made of the following pigments or the like, although not restricted thereto. As the black coloring agent, carbon black is used as a typical material. In particular, acid carbon carries on its surface polar group(s) such as COOH, OH or C=O, and therefore has a strong negative chargeability. Therefore, the oxidized carbon can be used particularly effectively when the toner is to be charged negatively.

The coloring agents for the colors other than black may be made of yellow, magenta and cyan pigments. The color image formation is performed by a subtractive color mixture method based on these pigment. The yellow pigment may be selected from, e.g., disazo yellow pigments such as Color Index (C. I.) Pigment Yellow 12, 13, 14, 17, 55, 81, 83 and others. The magenta pigment may be selectd from azolake magenta pigments such as C. I. Pigment Red 48, 57 (Carmin 6B), 5, 23, 60, 114, 146 or 186, an insoluble azo-magenta pigment, a thio-indigo magenta pigment, and a quinacridon magenta pigment such as C. I. Pigment Red 122 or 209. The cyan pigment may be, e.g., a copper phthalocyanine blue cyan pigment such as C. I. Pigment Blue 15:1 or 15:3.

The addition rate of the coloring agent with respect to the binder resin is preferably in a range from 5 to 20 weight parts with respect to 100 weight parts of the binder resin. The coloring agent may be dye. A resin which is colored in itself may be employed.

Various kinds of resin can be used as the binder resin for the toner particles provided that the resin has a thermal plasticity and does not substantially dissolve in the carrier liquid. For example, the binder resin may be thermoplastic saturated polyester resin, styrene/acrylic copolymer resin, polystyrene, polyvinyl chloride, polyvinyl acetate, polymethacrylic acid ester (polymethacrylate), polyacrylic acid ester (polyacrylate), polyethylene, epoxy resin, polyurethane, polyamide, paraffin wax and other resin. Only one kind of resin may be selected from the above, or two or more kinds of resin may be selected from the above for use in combination in a mixed or polymerized fashion. For controlling an amount of the functional group present on the resin surface, polyacrylic acid, polymethacrylic acid or copolymer of them may be added.

The thermoplastic saturated polyester resin is particularly preferable. The thermoplastic saturated polyester resin can widely change the characteristics of substance such as thermal characteristics, and further can provide beautiful coloring owing to its good transparency for the color image. Moreover, the thermoplastic saturated polyester resin has good ductility and malleability as well as good viscoelasticity so that the fixed resin film can be strong, and can be sufficiently adhered to the record member such as a sheet of paper.

The toner of the liquid developer is not required to be charged by friction with the charging members such as carrier particles in contrast to the toner for the dry development. Therefore, the toner for the liquid developer can be selected without giving consideration to damage (spent) of the toner, fusing and others. Accordingly, resin having a low melting point such as polyethylene, polyvinyl acetate and polystyrene can be used. Thereby, the amount of heat required for fixing the toner onto the record member can be reduced.

Then, the foregoing coloring mixture formed of the binder resin, coloring agent and, if necessary, additive(s) and others is roughly crushed by a rough crushing device such as a cutter mill, a hammer mill or a jet mill to produce particles having a particle diameter of about 1 mm or less. Then, wet grinding is effected on the roughly crushed toner in the carrier liquid containing the charge director and others dissolved therein so that the toner-dispersed liquid containing the toner of a predetermined particle diameter is prepared.

In the wet grinding, the roughly crushed toner is added into liquid having an electrically high resistance together with medium such as glass beads or zirconia beads, and a high shearing force is added to the toner by a finely crushing device such as a wet medium mill so that the rough particles are finely crushed. The wet medium mill may be Mitsubishi UF Mill (manufactured by Mitsubishi Juko Co., Ltd.), Eiger Motor Mill (manufactured by Eiger Japan Cop., Ltd.), Ultra-Visco Mill (manufactured by Imex Co., Ltd.), Spike Mill (manufactured by Inoue Seisakusho Co., Ltd.), Dino Mill (manufactured by WAB Co., Ltd. (WILLY. A BACHOFEN AG MACHINENFABRIK BASEL)) or the like.

The volume average particle diameter of the toner may be in a range from 0.1 $\mu$m to 10 $\mu$m, and is preferably in a range from 0.5 $\mu$m to 5 $\mu$m and more preferably in a range from 1 $\mu$m to 3 $\mu$m. If the volume average particle diameter of the toner particles is smaller than 0.1 $\mu$m, the zeta potential becomes excessively low so that the electric field cannot give a sufficiently large force to the toner in the developing process so that the mobility (moving speed) of the toner in the electrical migration (electrophoresis) is small, and the developing speed becomes low. If the system speed exceeds a predetermined value, a sufficient image density cannot be achieved. Further, a high electric field is required for the electrostatic transfer to the record medium, and the transferring cannot be performed without difficulty. If the volume average particle diameter of the toner particles is larger than 10 $\mu$m, the high definition images in high resolution cannot be obtained. The volume average particle diameter of the toner can be measured with a laser diffraction particle distribution measuring device.

It is desired that the electrically insulating liquid which can be used as the carrier liquid has an electric resistance value in a range from about $10^{11}$ Ω·cm to about $10^{16}$ Ω·cm, which does not disturb the electrostatic latent image. If the carrier liquid has an electric resistance value lower than about $10^{11}$ Ω·cm, image flow is likely to occur. Further, it is preferable to use solvent having neither odor nor toxicity, and having a relatively high inflammation point.

For example, it is possible to use aliphatic hydrocarbon, alicyclic hydrocarbon, aromatic hydrocarbon, halogenated hydrocarbon, polysiloxane and others. In view of odorless and nontoxic properties as well as a cost, it is particularly preferable to use normal paraffin solvent or isoparaffin solvent. More specifically, it is preferable to use Isoper G, Isoper H, Isoper L, Isoper M (each manufactured by Exon Co., Ltd.), Shellsol 71 (manufactured by Shell Oil Co., Ltd.), IP Solvent 1620, IP Solvent 2028 (each manufactured by Idemitsu Sekiyu Kagaku Co., Ltd.), 0 grade Solvent L, 0 grade Solvent M (each manufactured by Nippon Sekiyu Co., Ltd.), NS Clean 100, NS Clean 110, NS clean 200 and NS Clean 220 (each manufactured by Nikko Sekiyukagaku Co., Ltd.).

The charge director added thereto is substantially solvated or dissolved in the carrier liquid to cause dissociation and thus charges, and is absorbed onto the toner for affecting the chargeability of the toner. The charge director may be selected from the following substances, although not restricted thereto.

(1) A polymer or copolymer having nitrogen-containing monomer as a component and soluble in the carrier liquid. Specific examples are a polymer having as a component a monomer such as (meth)acrylates having an aliphatic amino group, vinyl monomers having nitrogen-containing heterocyclic ring, cyclic amide monomers having N-vinyl substituent, (meth)acrylamides, aromatic substituted ethylenic monomers having nitrogen-containing group, nitrogen-containing vinyl ether monomers or the like. Particularly preferable is a copolymer which is soluble in a hydrocarbon carrier liquid and containing a monomer such as hexyl (meth)acrylate, cyclohexyl (meth)acrylate, 2-ethylhexyl (meth)acrylate, octyl (meth)acrylate, nonyl (meth)acrylate, decyl (meth)acrylate, dodecyl (meth)acrylate, lauryl (meth) acrylate, stearyl (meth)acrylate, vinyl laurate, vinyl stearate, benzyl (meth)acrylate and pheny (meth)acrylate.

(2) Ionic surfactant made of, e.g., metal salt of aliphatic acid such as naphthenic acid, octenoic acid, oleic acid and stearic acid; metal salt of dialkylsulfosuccinic acid; metal salt of alkylbenzenesulfonic acid having alkyl group of up to 19 carbon atoms; metal salt of alkylphosphate; metal salt of abietic acid or hydrogenated abietic acid.

(3) Oil-soluble ionic surfactant such as alkylbenzenesulfonic acid salt having alkyl group(s) of at least 20 carbon atoms (calcium salt, barium salt, etc.), petroleum sulfonic acid salt (barium salt, calcium salt, magnesium salt), and basic petroleum sulfonic acid salt (barium salt, calcium salt, magnesium salt).

(4) Amphoteric surfactant such as lecithin, natural fats and oils such as linseed oil.

Each of the charge directors in the above items (1), (2), (3) and (4) may be used solely, or two or more of them may be used in a mixed fashion.

Among the charge directors, petroleum sulfonate (barium salt or calcium salt) and basic petroleum sulfonate (barium salt or calcium salt) are preferable in view of good chargeability of the toner particles. Examples of commercially available charge directors described above are Sulfol Ca-45N, Sulfol Ca-45, Sulfol 1040, Molescoamber SC-45N, Molescoamber SC-45, Sulfol Ba-30N, Molescoamber SB-50N (all manufactured by Matsumura Oil Research Corp.), Basic Barium Petronate, Neutral Barium Petronate, Basic Calcium Petronate, Neutral Calcium Petronate, Basic Magnesium Petronate (all manufactured by Witco Chemical Co., Ltd.) and others.

A dispersant (dispersion stabilizer) may be used for the toner. The dispersion stabilizer may be a polymer which is absorbed onto the toner particles, has affinity to liquid having a high electric resistance such as a carrier liquid, completely or partially dissolves in the carrier liquid or swells with the carrier liquid. These polymers are not specifically limited, but may include polyolefin type petroleum resin, linseed oil and poly(alkylmethacrylate). In order to enhance affinity to the toner particle, it is possible to use a copolymer containing a monomer having a polar group such as methacrylic acid, acrylic acid and alkylaminoethyl methacrylate. In this case, solubility to the carrier liquid or the like having a high electric resistance as well as affinity and adsorption to the toner particle are controlled based on an amount of the polar group of monomers to be copolymerized. The larger the amount of the polar group, the lesser the solubility to the carrier liquid is and the more the affinity and adsorption to the toner particle is.

In the process of producing the toner-dispersed liquid described above, the coloring binder resin in a range from about 5 to about 200 weight parts and, more preferably, in a range from about 20 to about 100 weight parts may be added to 100 weight parts of the carrier liquid, and the medium which is 0.5 to 2 times larger in weight part than the binder resin may be added for crushing. This is because an excessively small amount of resin would increase the amount of foregoing liquid which is required in the crushing process for obtaining an intended amount of toner, and thus would increase the cost. If the rate of the amount of resin were excessively large, it would be difficult to crush the resin so that it would be difficult to reduce the toner particle diameter to a predetermined value, or crushing would take an extremely long time before obtaining the intended particle diameter.

The amount of the charge director to be added depends on the kind thereof, but is preferably in a range of about 0.001 to about 3 times larger in weight part than the coloring binder resin. The range from about 0.01 to about 2 times is more preferable. If the addition rate of the charge director with respect to the binder resin were smaller than 0.001 times, it would be impossible to obtain a sufficient charge amount of the toner so that the developing speed would be excessively low, or the toner would not be dispersed sufficiently in the carrier liquid. Even the addition rate of the charge director with respect to the binder resin were larger than 3 times, the amount of the charge director absorbed to the toner would not exceed a predetermined value, but conversely the amount of surplus charge director floating in the carrier liquid would increase, resulting in unpreferable lowering of the electric resistance value of the carrier liquid.

The addition rate of the foregoing dispersant with respect to 100 weight parts of the carrier liquid is preferably in a range from about 0.01 to about 20 weight parts, and is more preferably in a range from about 0.1 to 10 weight parts in view of improvement of the dispersibility of the toner and prevention of increase in viscosity of the carrier liquid due to the addition of the dispersant. If the sufficient toner dispersibility is achieved only by addition of the charge director, addition of the dispersant is not required.

The high-concentration toner-dispersed liquid thus obtained can be used as the concentrated liquid developer (concentrated liquid). The liquid component can be obtained by removing the solid components including the toner from the high-concentration toner-dispersed liquid produced in the similar manner, and the liquid component thus obtained can be used as the diluent.

For developing the electrostatic latent image, the concentrated liquid is diluted with the diluent to achieve a predetermined toner concentration, and the liquid thus diluted can be used as the initial liquid developer (starter). When the toner concentration of the starter lowers, the concentrated liquid is supplied (i.e., added). When the toner concentration increases and/or the liquid amount lowers, the diluent is supplied. Thereby, the toner concentration of the liquid developer used for development is kept constant, and the liquid amount is kept at the appropriate level allowing the development.

The toner concentration of the liquid developer used for development is preferably substantially in a range from 0.5 to 10 weight parts with respect to 100 weight parts of the carrier liquid. More preferably, it is in a range from 1 to 5 weight parts. If the toner concentration exceeds the above range, the surplus toner which did not contribute to the development adheres onto a white portion other than the image portions, and thus a so-called "image fogging" occurs. If the toner concentration is lower than the above range, a sufficiently high image density cannot be achieved.

According to this method, the liquid developer used for development as well as the concentrated liquid and the diluent are all obtained from the toner-dispersed liquid subjected to the same crushing step. Therefore, the liquid component of the liquid developer and the liquid component of the concentrated liquid can have the same conductivity and the same charge director concentration.

According to this method, the concentrated liquid and the diluent can be manufactured from the toner-dispersed liquid of similar concentrations, and the liquid developer can be manufactured by mixing the concentrated liquid and the diluent together. Therefore, these liquids can be manufactured without expense in time and effort.

The carrier liquid containing the charge director and the solid component containing the toner in the foregoing toner-dispersed liquid can be separated from each other, for example, in such a manner that the toner-dispersed liquid is left at rest for plain sedimentation of the solid component, the solid component and the liquid component in the toner-dispersed liquid are subjected to centrifugal separation, or an electric field is applied to the toner-dispersed liquid from an electrodeposition electrode for electro-depositing the solid component onto the electrode.

The diluent obtained in this method can be considered as the liquid component which can be obtained by removing the solid component including the toner from the liquid developer.

(2) Combination 2

The liquid component of the high-concentration toner-dispersed liquid obtained by the foregoing method is separated from the solid component containing the toner, and the liquid thus separated is used as the diluent. The carrier liquid is added to the solid component which was left in the above separating step, and the toner is dispersed again. The liquid thus prepared is used as the concentrated liquid. The carrier liquid was not completely separated in the foregoing step, and therefore is partially left in the solid component. The amount of the carrier liquid, which is added in the process of manufacturing the concentrated liquid, is determined such that the charge director concentration of the liquid component in the concentrated liquid is equal to the charge director concentration of the diluent.

For development of the electrostatic latent image, the starter can be prepared by diluting the concentrated liquid with the diluent to achieve the predetermined toner concentration. The toner concentration of the liquid developer which is used for the development is kept constant by appropriately supplying the concentrated liquid and the diluent. According to this method, the liquid developer used for development, the concentrated liquid and the diluent are prepared through the same crushing step. Therefore, the liquid component of liquid developer used for development, the liquid component of concentrated liquid and the diluent can have the substantially same conductivity and the substantially same charge director concentration.

According to this method, the concentrated liquid and the diluent can be simultaneously manufactured from the same a high-concentration toner-dispersed liquid, and the liquid developer can be manufactured by a mixture of the concentrated liquid and the diluent. Therefore, these liquids can be manufactured without expense in time and effort.

(3) Combination 3

The high-concentration toner-dispersed liquid which is obtained in the foregoing method is used as the concentrated liquid. Processing similar to the foregoing wet grinding is effected on the carrier liquid containing the charge director in the same concentration as that of the charge director in the liquid component, which is obtained by removing the solid component including the toner from the concentrated liquid. The liquid thus processed is used as the diluent. The processing similar to the wet grinding can be performed for a period from about 2 to about 20 hours, depending on the kind, concentration and others of the charge director. If the period is shorter than 2 hours, the above processing cannot sufficiently achieve the effect. Further, the period longer than 20 hours cannot achieve further improved effects. For conducting the processing similar to the wet grinding, the foregoing dispersant and other various additives may be added to the carrier liquid in addition to the charge director.

For development of the electrostatic latent image, a liquid prepared by diluting the concentrated liquid with the diluent and having a predetermined toner concentration can be used as the starter. The concentrated liquid and the diluent are appropriately added to the starter to keep the constant toner concentration of the liquid developer used for development. According to this method, the liquid developer used for development, the concentrated liquid and the diluent are all prepared through the same crushing step. Therefore, the substantially same conductivity and the substantially same charge director concentration can be achieved in all the liquid developer used for development, the concentrated liquid and the diluent.

In addition to the above characteristic changing method, in which the carrier liquid solution of the charge director is subjected to the processing similar to the wet grinding performed for manufacturing the concentrated liquid, various methods may be selected for changing the characteristics of the charge director. For example, the characteristics can be changed by applying the stress in such a manner that the solution is stirred while keeping it in a temperature range from 50° C. to 80° C., that the dispersing processing is performed by an ultrasonic dispersing device for a long time, or that the concentration of the charge director is increased and the highly viscous solution thus prepared is kneaded by a kneader with rolls. In any one of the above methods, it is merely required that the liquid component of the liquid developer used for development, the liquid component of the concentrated liquid and the diluent have the substantially same conductivity and the substantially same charge director concentration.

The diluent obtained by the foregoing method can be deemed as the liquid prepared by applying a predetermined stress to the carrier liquid, which contains the charge director in the same concentration as the liquid component prepared by removing the solid component including the toner from the liquid developer used for development, and thereby having the charge director concentration and the conductivity which are equal to those of the liquid component of the liquid developer.

The invention will now be described below with reference to experimental examples, although the invention is not restricted thereto. In the following description, "parts" represents "weight parts", and "Tg" represents a "glass transition temperature" unless otherwise specified. "Mw" represents a weight average molecular weight, and "Mn" represents a number average molecular weight.

In the following examples, the number average molecular weight (Mn) and the weight average molecular weight (Mw) were obtained from the result of gel permeation chromatography (GPC), which was performed with a high speed liquid chromatograph pump TRI ROTAR-V type (manufacture by Nippon Bunkou Co., Ltd.), an ultraviolet spectrometer UVIDEC-100-V type (manufactured by Nippon Bunkou Co., Ltd.) and a 50 cm-long column Shodex GPC A-803 (manufactured by Showa Denko Co., Ltd.). The weight average molecular weight (Mw) was obtained as the weight average molecular weight (Mw) in term of polystyrene from the result of the chromatography, and more specifically by employing polystyrene as the standard substance and calculating the molecular weight of the test sample. The number average molecular weight (Mn) was likewise obtained from the result of the chromatography. The test sample was prepared by dissolving 0.05 g of binder resin in 20 ml of tetrahydrofuran (THF).

The glass transition temperature (Tg) was measured by a differential scanning calorimeter DSC-20 (manufactured by Seiko Denshi Kogyo Co., Ltd.) under the conditions of the sample quantity of 10 mg and the temperature rising speed of 10° C./min. The standard substance was powder of alpha-alumina. The temperature of the test sample was once raised to a value higher than Tg, and then was lowered. Thereafter, the temperature was raised to a value higher than Tg again, and the raised temperature was kept for ten minutes. Thereafter, the value of Tg was measured with the second RUN.

The acid value was measured under the conditions specified by JIS K5400.

Figure 3:
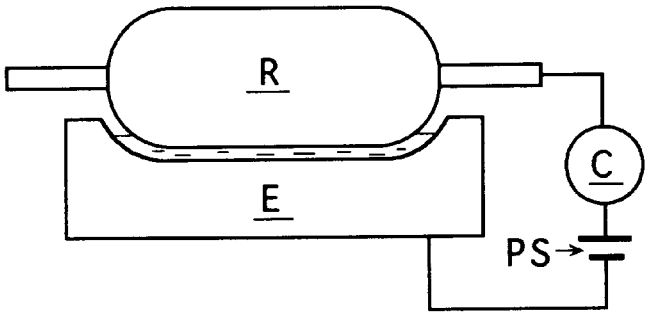
FIG. 3 shows a schematic structure of a charge amount measuring device.

The electric conductivities of the liquid component of the liquid developer, the liquid component of the concentrated liquid and the diluent were compared based on the amounts of moved charges in 0.2 ml of liquid which were measured by a charge amount measuring device shown in FIG. 3 with a voltage of 500 V applied for 10 msec.

Manufacturing of Binder Resin (thermoplastic saturated polyester resin)

To a round bottom flask equipped with a reflux condenser, separator of water and alcohol, nitrogen gas introducing tube, thermometer and stirrer were placed 1450 parts of bisphenol A-ethylene oxide adduct and 890 parts of isophthalic acid. The mixture was heated at 200 to 240° C. with introducing nitrogen gas and stirring to conduct polycondensation reaction with dehydration. When an acid value of the polyester resin thus formed or a viscosity of the reaction solution reached a desired value, the reaction mixture was cooled to or below 100° C. to terminate the polycondensation reaction. Thus, a thermoplastic saturated polyester resin was obtained.

The polyester resin thus formed was 6500 in Mw, 2500 in Mn, 55.1° C. in Tg and 25.0 mgKOH/g in acid value.

EXPERIMENTAL EXAMPLE 1

(1) Manufacturing of Concentrated Liquid

A mixture of 60 parts of the foregoing polyester resin and 40 parts of coloring agent, i.e., carbon black Morgal L (manufactured by Cyabot Co., Ltd.) was kneaded at 180° C. for four hours by a kneader with three rolls, and thereby a high-concentration pigment mixture was prepared. This high-concentration coloring agent mixture was diluted with the foregoing polyester resin by a kneader so that the coloring resin mixture containing 15 wt % of carbon black was produced. The coloring resin mixture was sufficiently cooled, and then was roughly crushed by a cutter mill. Thereafter, the mixture was finely crushed by a jet mill (Nippon Pneumatic Kogyo Co., Ltd.) to produce coloring toner rough particles having an average particle diameter of about 10 μm. Thirty grams of the coloring toner rough particles were mixed with 70 grams of 0 grade solvent L containing 8 wt % of barium salt of petroleum sulfonic acid Sulfol Ba-30N (Matsumura Oil Reseach Corp.). Wet grinding was effected on this mixture by performing processing for 15 hours with a sand grinder (IGARASHI KIKAI SEIZO Co., Ltd.), a media formed of 170 cc of glass beads having a diameter of 1 mm, a ⅛-gallon vessel with water-jacket, a cooling water temperature of 20° C. and a disk rotation speed of 2000 rpm. Thereby, the concentrated liquid developer was obtained.

A liquid diluted by 5 times by weight was prepared by adding 400 grams of 0 grade Solvent L to this concentrated liquid developer thus formed.

The liquid thus diluted was processed by a centrifugal separator H-110A (manufactured by Kokusan Co., Ltd.) with 3000 rpm for 45 minutes so that the solid component and the liquid component were separated from each other. The solid component thus obtained was 43.2 grams. Since the centrifugal separator cannot completely remove the liquid component, the solid component contains the carrier liquid, in which petroleum sulfonic acid barium salt, i.e., the charge director is dissolved, in addition to the coloring agent. The 0 grade Solvent L was added to this solid component to increase the total weight to 100 grams so that the concentrated liquid 1 including 19.6 wt % of solid component was finally prepared. This solid component which was finally contained was the solid component, which was separated from the final concentrated liquid 1 when the processing was performed by the centrifugal separator H-9R (Kokusan Co., Ltd.) with 10000 rpm for 10 minutes.

The concentrated liquid 1 was processed by the centrifugal separator H-9R (Kokusan Co., Ltd.) with 10000 rpm for 10 minutes so that the solid component and the liquid component were separated from each other. The concentration of the charge director contained in the liquid component thus separated, i.e., the surplus charge director was measured by an ultraviolet/visible ray absorption spectrum measuring device U-3210 (manufactured by Hitachi Seisakusho Co., Ltd.), and the result was 0.48 wt %. The amount of moved charges in 0.2 ml of this liquid was measured by the charge amount measuring device in FIG. 3, and the result of 0.0727 μC was obtained.

All the charge amounts described below were the amounts of moved charges in 0.2 ml of liquid.

(2) Manufacturing of Diluent

The liquid prepared by diluting the foregoing first-mentioned concentrated liquid developer by 5 times was processed by the centrifugal separator H-110A (manufactured by Kokusan Co., Ltd.) with 3000 rpm for 45 minutes so that the liquid component forming the diluent 1 was obtained. The charge director concentration of this diluent was likewise measured, and the result was 0.5 wt %. The amount of moved charges was likewise measured, and the result was 0.0755 μC. This charge director concentration was low in view of the amount of the charge director which was initially added. This is probably due to the fact that a part of the charge director was absorbed to the toner particles and the glass beads used for the wet grinding.

(3) Manufacturing of Liquid Developer

The concentrated liquid developer 1 was diluted with the diluent 1 to provide the toner concentration of 3 wt %. Dispersing processing was effected on this diluted liquid by the dispersing device T. K. autohomomixer M-type (manufactured by Tokushu Kika Kogyo Co., Ltd.) with 10000 rpm for 5 minutes. Thereby, the liquid developer 1 was produced.

The liquid developer 1 was processed by the centrifugal separator H-9R with 10000 rpm for 10 minutes so that the solid component and the liquid component were separated from each other. The concentration of the charge director contained in the liquid component thus separated was likewise measured. The result was 0.50 wt %. The amount of charges in the liquid component was likewise measured. The result was 0.0738 μC.

EXPERIMENTAL EXAMPLE 2

(1) Manufacturing of Concentrated Liquid

The concentrated liquid used in this example is the same as the concentrated liquid 1 manufactured in the experimental example 1. The concentration of the charge director contained in the liquid component of this concentrated liquid was 0.48 wt %, and the amount of moved charges was 0.0727 μC.

(2) Manufacturing of Diluent

Since the liquid component of the above concentrated liquid 1 had the charge director concentration of 0.48 wt , the following processing was performed to obtain a diluent 2 in view of this. One hundred grams of the 0 grade solvent L solution containing 0.5 wt % of barium salt of petroleum sulfonic acid Sulfol Ba-30N was processed for 15 hours with a sand grinder, a media formed of 170 cc of glass beads having a diameter of 1 mm, a ⅛-gallon vessel with water-jacket, a cooling water temperature of 20° C. and a disk rotation speed of 2000 rpm.

Similarly to the experimental example 1, the concentration of the charge director and the amount of moved charges were measured. The results were 0.47 wt % and 0.0719 μ

(3) Manufacturing of Liquid Developer

The concentrated liquid developer 1 was diluted with the diluent 2 to provide the toner concentration of 3 wt . Dispersing processing was effected on this diluted liquid by the dispersing device T. K. autohomomixer M-type with 10000 rpm for 5 minutes. Thereby, the liquid developer 2 was produced.

The liquid developer 2 was processed by the centrifugal separator H-9R with 10000 rpm for 10 minutes so that the solid component and the liquid component were separated from each other. The concentration of the charge director contained in the liquid component thus separated was likewise measured. The result was 0.48 wt %. The amount of charges in the liquid component was likewise measured. The result was 0.0721 μC.

EXPERIMENTAL EXAMPLE 3

(1) Manufacturing of Concentrated Liquid

A mixture of 60 parts of the foregoing polyester resin and 40 parts of coloring agent, i.e., carbon black Morgal L was kneaded at 180° C. for four hours by a kneader with three rolls, and thereby a high-concentration pigment mixture was prepared. This high-concentration coloring agent mixture was diluted with the foregoing polyester resin by a kneader so that the coloring resin mixture containing 15 wt % of carbon black was produced. The coloring resin mixture was sufficiently cooled, and then was roughly crushed by a cutter mill. Thereafter, the mixture was finely crushed by a jet mill to produce coloring toner rough particles having an average particle diameter of about 10 μm. Thirty grams of the coloring toner rough particles were mixed with 70 grams of 0 grade solvent L containing 2 wt % of barium salt of petroleum sulfonic acid Sulfol Ba-30N. Wet grinding was effected on this mixture by performing processing for 15 hours with a sand grinder, a media formed of 170 cc of glass beads having a diameter of 1 mm, a 1/8-gallon vessel with water-jacket, a cooling water temperature of 20° C. and a disk rotation speed of 2000 rpm. Thereby, the concentrated liquid developer, i.e., the concentrated liquid 2 including 29.5 wt % of solid component was obtained.

The concentrated liquid 2 was processed by the centrifugal separator H-9R with 10000 rpm for 10 minutes so that the solid component and the liquid component were separated from each other. The concentration of the charge director contained in the liquid component thus separated, i.e., the surplus charge director was measured by the ultraviolet/visible ray absorption spectrum measuring device U-3210, and the result was 1.58 wt %. The amount of moved charges in this liquid was measured by the charge amount measuring device in FIG. 3, and the result of 0.2253 μC was obtained. This charge director concentration was low in view of the amount of the charge director which was initially added. This is probably due to the fact that a part of the charge director was absorbed to the toner particles and the glass beads used for the wet grinding.

(2) Manufacturing of Diluent

The concentrated liquid developer was prepared similarly to the foregoing experimental example 1. The concentrated liquid developer, which was not diluted, was processed by the centrifugal separator H-110A with 3000 rpm for 45 minutes so that the solid component and the liquid component were separated from each other. The separated liquid component was collected, and the charge director concentration and the moved charge amount therein were measured. The measured charge director concentration was 2.61 wt %, and the measured charge amount was 0.3945 μC.

Since this charge director concentration was excessively higher than that of the concentrated liquid 2, this liquid component was diluted by 1.65 (2.61/1.58) times with the 0 grade Solvent L so that a diluent 3 containing the charge director in the concentration of 1.58 wt % was obtained. Thereby, the charge amount went to 0.2382 μC.

(3) Manufacturing of Liquid Developer

The concentrated liquid 2 was diluted with the diluent 3 to provide the toner particle concentration of 3 wt %. Dispersing processing was effected on this diluted liquid by the dispersing device T. K. autohomomixer M-type with 10000 rpm for 5 minutes. Thereby, the liquid developer 3 was produced.

The liquid developer 3 was processed by the centrifugal separator H-9R with 10000 rpm for 10 minutes so that the solid component and the liquid component were separated from each other. The concentration of the charge director contained in the liquid component thus separated was likewise measured. The result was 1.57 wt %. The amount of moved charges in the liquid component was likewise measured. The result was 0.2377 μC.

EXPERIMENTAL EXAMPLE 4

(1) Manufacturing of Concentrated Liquid

The concentrated liquid developer 2, which was manufactured in the experimental example 3, was used without diluting the same. The liquid component of this concentrated liquid had the charge director concentration of 1.58 wt % and the charge amount of 0.2253 μC.

(2) Manufacturing of Diluent

Since the liquid component of the concentrated liquid 2 had the charge director concentration of 1.58 wt , the following processing was performed to obtain a diluent 4 in view of this. One hundred grams of 0 grade solvent L containing 1.6 wt % of barium salt of petroleum sulfonic acid Sulfol Ba-30N was processed for 15 hours with a sand grinder, a media formed of 170 cc of glass beads having a diameter of 1 mm, a ⅛-gallon vessel with water-jacket, a cooling water temperature of 20° C. and a disk rotation speed of 2000 rpm.

Similarly to the foregoing experimental examples, the concentration of the charge director and the amount of charges were measured. The results were 1.55 wt % and 0.2203 μC.

(3) Manufacturing of Liquid Developer

The concentrated liquid 2 was diluted with the diluent 4 to provide the toner particle concentration of 3 wt %. Dispersing processing was effected on this diluted liquid by the dispersing device T. K. autohomomixer M-type with 10000 rpm for 5 minutes. Thereby, the liquid developer 4 was produced.

The liquid developer 4 was processed by the centrifugal separator H-9R with 10000 rpm for 10 minutes so that the solid component and the liquid component were separated from each other. The concentration of the charge director contained in the liquid component thus separated was likewise measured. The result was 1.56 wt %. The amount of charges in the liquid component was likewise measured. The result was 0.2241 μC.

EXPERIMENTAL EXAMPLE 1 FOR COMPARISON (1) Manufacturing of Concentrated Liquid The concentrated liquid 1 manufactured in the experimental example 1 was used as it was. The concentration of the charge director contained in the liquid component of this concentrated liquid 1 was 0.48 wt %, and the amount of charges was 0.0727 μC as already described.

(2) Manufacturing of Diluent

Since the concentrated liquid 1 had the charge director concentration of 0.48 wt %, the 0 grade solvent L solution containing 0.5 wt % of barium salt of petroleum sulfonic acid Sulfol Ba-30N was prepared in view of this, and this solution was used as a diluent 5. The diluent 5 had the charge amount of 0.1073 μC.

(3) Manufacturing of Liquid Developer

The concentrated liquid developer 1 was diluted with the diluent 5 to provide the toner concentration of 3 wt %. Dispersing processing was effected on this diluted liquid by the dispersing device T. K. autohomomixer M-type with 10000 rpm for 5 minutes. Thereby, the comparative liquid developer 1 was produced.

The comparative liquid developer 1 was processed by the centrifugal separator H-9R with 10000 rpm for 10 minutes so that the solid component and the liquid component were separated from each other. The concentration of the charge director contained in the liquid component thus separated as well as the amount of charges in the liquid component were likewise measured. The results were 0.50 wt % and 0.0976 μC.

EXPERIMENTAL EXAMPLE 2 FOR COMPARISON (1) Manufacturing of Concentrated Liquid The concentrated liquid 1 manufactured in the experimental example 1 was used as it was. The concentration of the charge director contained in the liquid component of this concentrated liquid 1 was 0.48 wt %, and the charge amount was 0.0727 μC as already described.

(2) Manufacturing of Diluent

Figure 2:
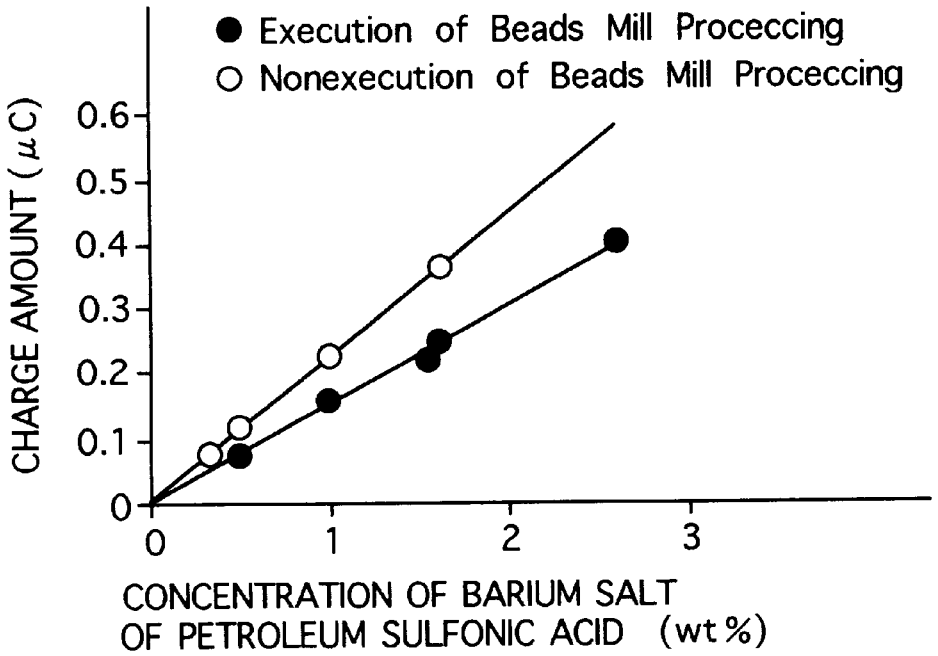
FIG. 2 shows a relationship between a concentration of barium salt of petroleum sulfonic acid and an amount of moved charges per 0.2 ml.

Since the concentrated liquid 1 had the charge amount of 0.0727 μC, the 0 grade solvent L solution containing 0.33 wt % of barium salt of petroleum sulfonic acid Sulfol Ba-30N was prepared in view of this. This charge director (petroleum sulfonic acid barium salt) concentration of 0.33 wt % corresponds to the charge amount of 0.0727 μC when calculated from the analytical curve shown in FIG. 2 whch was determined in the case where the bead mill processing was not effected. The solution thus prepared was used as a diluent 6. Therefore, the diluent 6 has the charge director concentration of 0.33 wt % and the charge amount of 0.728 μC.

(3) Manufacturing of Liquid Developer

The concentrated liquid developer 1 was diluted with the diluent 6 to provide the toner concentration of 3 wt %. Dispersing processing was effected on this diluted liquid by the dispersing device T. K. autohomomixer M-type with 10000 rpm for 5 minutes. Thereby, the comparative liquid developer 2 was produced.

The comparative liquid developer 2 was processed by the centrifugal separator H-9R with 10000 rpm for 10 minutes so that the solid component and the liquid component were separated from each other. The concentration of the charge director contained in the liquid component thus separated as well as the amount of charges in the liquid component were likewise measured. The results were 0.37 wt % and 0.0728 μC.

EXPERIMENTAL EXAMPLE 3 FOR COMPARISON (1) Manufacturing of Concentrated Liquid The concentrated liquid 2 manufactured in the experimental example 3 was used as it was. The concentration of the charge director contained in the liquid component of this concentrated liquid 2 was 1.58 wt %, and the charge amount was 0.2253 μC as already described.

(2) Manufacturing of Diluent

Since the concentrated liquid 2 had the charge director concentration of 1.58 wt %, the 0 grade solvent L solution containing 1.6 wt % of barium salt of petroleum sulfonic acid Sulfol Ba-30N was prepared in view of this, and this solution was used as a diluent 7. The diluent 7 had the charge amount of 0.3550 μC.

(3) Manufacturing of Liquid Developer

The concentrated liquid developer 2 was diluted with the diluent 7 to provide the toner concentration of 3 wt %. Dispersing processing was effected on this diluted liquid by the dispersing device T. K. autohomomixer M-type with 10000 rpm for 5 minutes. Thereby, the comparative liquid developer 3 was produced.

The comparative liquid developer 3 was processed by the centrifugal separator H-9R with 10000 rpm for 10 minutes so that the solid component and the liquid component were separated from each other. The concentration of the charge director contained in the liquid component thus separated as well as the amount of charges in the liquid component were likewise measured. The results were 1.6 wt % and 0.3386 μC.

EXPERIMENTAL EXAMPLE 4 FOR COMPARISON (1) Manufacturing of Concentrated Liquid The concentrated liquid 2 manufactured in the experimental example 3 was used as it was. The concentration of the charge director contained in the liquid component of this concentrated liquid 2 was 1.58 wt %, and the charge amount was 0.2253 μC as already described.

(2) Manufacturing of Diluent

Since the concentrated liquid 2 had the charge amount of 0.2253 μC, the 0 grade solvent L solution containing 1.00 wt % of barium salt of petroleum sulfonic acid Sulfol Ba-30N was prepared in view of this. This charge director (petroleum sulfonic acid barium salt) concentration of 1.00 wt % corresponds to the charge amount of 0.2253 μC when calculated from the analytical curve shown in FIG. 2 which was determined in the case where the bead mill processing was not effected.

The solution thus prepared was used as a diluent 8. Therefore, the diluent 8 had the charge director concentration of 1.00 wt % and the charge amount of 0.2219 pμC.

(3) Manufacturing of Liquid Developer

The concentrated liquid 2 was diluted with the diluent 8 to provide the toner concentration of 3 wt %. Dispersing processing was effected on this diluted liquid by the dispersing device T. K. autohomomixer M-type with 10000 rpm for 5 minutes. Thereby, the comparative liquid developer 4 was produced.

The comparative liquid developer 4 was processed by the centrifugal separator H-9R with 10000 rpm for 10 minutes so that the solid component and the liquid component were separated from each other. The concentration of the charge director contained in the liquid component thus separated as well as the amount of charges in the liquid component were likewise measured. The results were 1.15 wt % and 0.2236 μC. The following table 1 shows the charge director concentrations and the charge amounts of the liquid components of the concentrated liquids, the diluents and the liquid components of the liquid developers which were manufactured in the experimental examples 1–4 and the experimental examples 1–4. for comparison. In the table 1, "CD" represents the charge director concentration. The experimental examples 1–4 are represented as "EXE 1–4". The comparative experimental examples 1–4 are represented as "CEE 1–4". Further, the concentrated liquid is represented as "CnLq", and the liquid developer for development is represented as "LqDv". The charge amount is represented as "CH".

TABLE 1

| | CnLq | | Diluent | | LqDv | |
|---|---|---|---|---|---|---|
| | CD (wt %) | CH (μC) | CD (wt %) | CH (μC) | CD (wt %) | CH (μC) |
| EXE 1 | 0.48 | 0.0727 | 0.50 | 0.0755 | 0.50 | 0.0738 |
| EXE 2 | 0.48 | 0.0727 | 0.47 | 0.0719 | 0.48 | 0.0721 |
| EXE 3 | 1.58 | 0.2253 | 1.58 | 0.2382 | 1.57 | 0.2377 |
| EXE 4 | 1.58 | 0.2253 | 1.55 | 0.2203 | 1.56 | 0.2241 |
| CEE 1 | 0.48 | 0.0727 | 0.50 | 0.1073 | 0.50 | 0.0976 |
| CEE 2 | 0.48 | 0.0727 | 0.33 | 0.0728 | 0.37 | 0.0728 |
| CEE 3 | 1.58 | 0.2253 | 1.60 | 0.3550 | 1.60 | 0.3386 |
| CEE 4 | 1.58 | 0.2253 | 1.00 | 0.2219 | 1.15 | 0.2236 |

Image formation was actually performed with the concentrated liquids, diluents and liquid developers manufactured in the experimental examples 1–4 and the comparative experimental examples 1–4, and changes in image density were evaluated as described below. The changes in image density were evaluated by the actual image forming test using an image formation experimental apparatus, which had a schematic structure shown in FIG. 4 and used the respective liquid developers controlled to have the constant toner concentration. For this, the toner concentration and the liquid amount were controlled by the concentrated liquid and the diluent.

Figure 4:
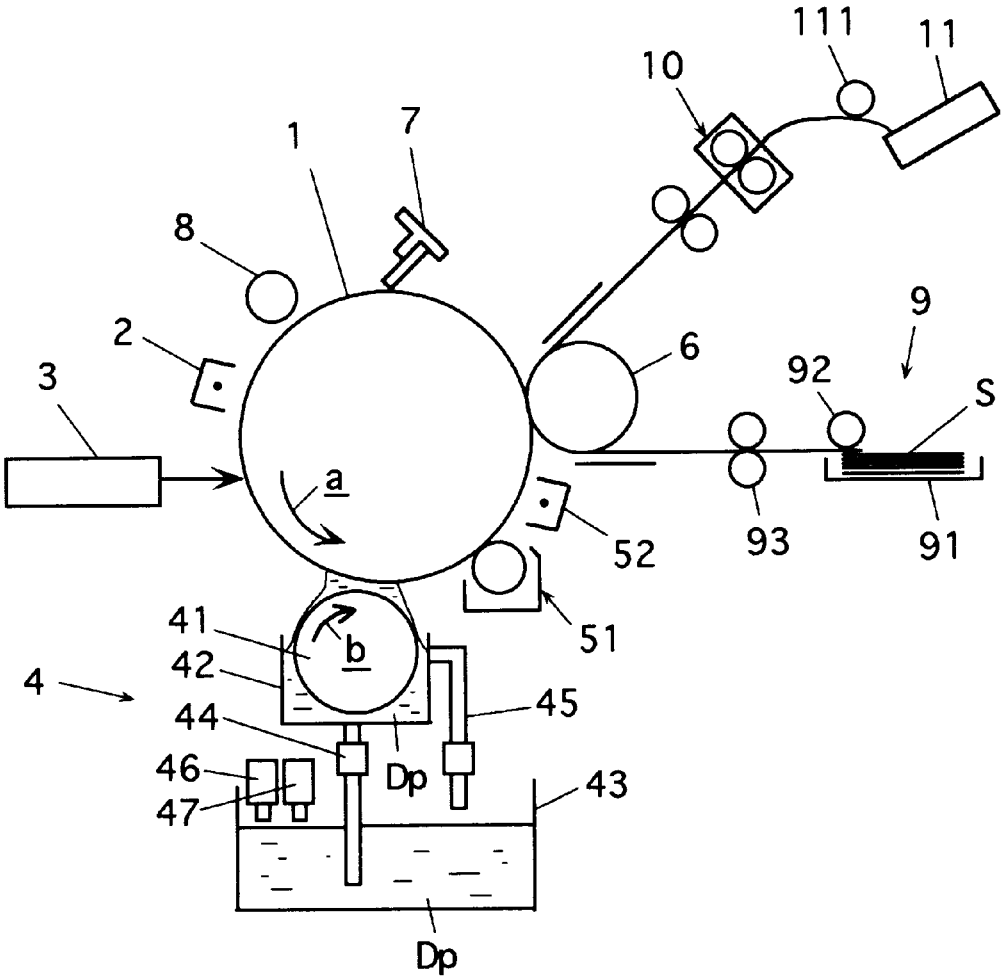
FIG. 4 shows a schematically structure of an image formation experimental device.

The experimental image forming apparatus shown in FIG. 4 is of an electrophotographic type, and is internally provided with a liquid developing device. The apparatus has a photosensitive drum 1, and also includes a charger 2, an image exposing device 3 for emitting a laser beam based on an image ata sent from a host computer or the like (not shown), a liquid developing device 4, a squeeze roller device 51, a squeeze charger 52, a transfer roller 6, a cleaner 7 and an eraser lamp 8, which are successively arranged around the photosensitive drum 1. Near the transfer roller 6, there are arranged a sheet supply device 9, a fixing device 10 which includes a thermal fixing roller pair for fixing a toner image formed on the sheet, and a discharged sheet tray 11 for receiving sheets discharged from the apparatus. A sheet discharge roller pair 111 is provided for the discharged sheet tray 11. The sheet supply device 9 includes a sheet cassette 91 accommodating the record sheets S, and a feed roller 92 for feeding the sheets from the cassette 91. A timing roller pair 93 is arranged between the sheet supply device 9 and the transfer roller 6.

The liquid developing device 4 includes a developing roller 41 which is opposed to the photosensitive drum 1 with a minute space therebetween, and has a lower portion immersed in the liquid developer Dp, a developer retaining tank 42 for retaining the liquid developer around the developing roller 41, a developer reservoir 43 for reserving the liquid developer Dp to be supplied to the developer retaining tank 42, a liquid developer supply device 44 which scoops and supplies the developer in the developer reservoir 43 to the developer retaining tank 42, and a developer collecting device 45 which returns the surplus developer in the developer retaining tank 42 to the developer reservoir 43. The developer Dp in the developer reservoir 43 is appropriately supplied with the concentrated liquid developer and the diluent to keep the substantially constant toner concentration. These concentrated liquid developer and the diluent are supplied from a concentrated liquid developer (concentrated liquid) supply device 46 and a diluent supply device 47 based on results of detection by a toner concentration sensor and a liquid amount sensor (both not shown). A developing gap between the developing roller 41 and the photosensitive drum 1 can be freely adjusted within a range from 0 mm to 2 mm.

For the image formation, the photosensitive drum 1 rotates in a direction of an arrow a in FIG. 4 at a speed of 800 mm/sec, and the charger 2 uniformly charges the surface of the photosensitive drum 1 to carry a surface potential of about −500 V. The image exposing device 3 emits the laser beams based on the image information to the photosensitive drum 1 so that an electrostatic latent image is formed on the surface of the photosensitive drum 1. The area of the exposed portion of the surface of the photosensitive drum 1 is substantially equal to 30% of the whole surface area of the photosensitive drum 1. Thereby, the surface potential of the exposed portion of the photosensitive drum 1 is lowered to about −30 V.

The electrostatic latent image formed on the photosensitive drum 1 is visualized with the liquid developer Dp by the liquid developing device 4. The developing roller 41 rotates at a rotating speed 1.5 times larger than that of the photosensitive drum 1 in a direction of an arrow b in the figure, which is opposite to the rotating direction of the photosensitive drum 1. A developing gap of 100 μm is kept between the photosensitive drum 1 and the developing roller 41. A bias potential of about −350 V is applied to the developing roller 41 for promoting adhesion of the toner onto the exposed portion and suppressing adhesion of the toner onto the unexposed portion.

Thereafter, the squeeze roller device 51, which rotates in the same direction as the photosensitive drum 1, and the sqeeze charger 52 squeeze and remove the surplus liquid developer adhered onto the photosensitive drum 1, and the toner image containing a slight amount of the liquid is formed on the surface of the photosensitive drum 1. The toner image thus formed moves to a transfer position opposed to the transfer roller 6. In the transfer position, the toner image comes into contact with the paper sheet S transferred from the sheet supply device 9, and is electrostatically transferred onto the sheet. The transfer roller 6 carries a transfer voltage of +1000 V.

The transfer sheet S is separated from the photosensitive drum 1, and then is sent to the fixing device 10 which includes a thermal fixing roller pair heated to 150° C. The fixing device 10 fixes the image by the heat and pressure so that image formation on the sheet is completed. The sheet is then discharged by the discharge roller pair 111 onto the discharged sheet tray 11. Thereafter, the cleaner 7 removes the residual liquid developer on the surface of the photosensitive drum 1, and the eraser lamp 8 removes the residual charges on the photosensitive drum 1 for the next image formation.

The changes in image density were evaluated in the following manner. An electrostatic latent image, which has a belt-like form, and is 20 cm in the longitudinal direction (parallel to the rotation axis of the photosensitive drum 1) and 5 cm in the peripheral direction, was formed on the photosensitive drum 1, and was visualized to provide a belt-like image of 20 cm by 5 cm. This image formation was repeated 100,000 times, and a ratio between the image density after repeating the image formation 100,000 times and the initial image density. The image densities were obtained as follows. Reflection density was measured by a densitometer PDM5 (SAKURA Co., Ltd.) at three portions of the band-like image. These portions are all located in the center with respect to the rotating direction of the photosensitive drum, and are respectively located at the longitudinally central position and the positions spaced in the longitudinal direction by 5 cm from the opposite ends, respectively. An average was obtained from the values measured at these portions, and thereby the above ratios were obtained. The results are shown in the following table 2. In the following table, the initial image density is represented as "IntDs", the density after repeating the image formation 100,000 times is represented as "DsAft", and the above ratio (DsAft/IntDs) is represented as "Ratio".

TABLE 2

| | IntDs | DsAft | Ratio (%) |
|---|---|---|---|
| EXE 1 | 1.25 | 1.24 | 99.20 |
| EXE 2 | 1.27 | 1.27 | 100.00 |
| EXE 3 | 0.78 | 0.75 | 96.15 |
| EXE 4 | 0.80 | 0.78 | 97.50 |
| CEE 1 | 1.08 | 0.59 | 54.63 |
| CEE 2 | 1.27 | 0.96 | 75.59 |
| CEE 3 | 0.61 | 0.37 | 60.66 |
| CEE 4 | 0.77 | 0.53 | 68.83 |

As described above, the image densities did not significantly lower even repeating the image formation 100,000 times if the concentrated liquid and the diluent were supplied to keep the constant toner concentration according to the embodiments 1–4, in which the liquid component of the liquid developer, the liquid component of the concentrated liquid and the diluent had the substantially same charge director concentration and the substantially same moved charge amount per unit volume. However, the image densities significantly lowered after repeating the image formation 100,000 times according to the comparative examples 1–4, in which the liquid component of the liquid developer, the liquid component of the concentrated liquid and the diluent had different charge director concentrations and different charge amounts per unit volume.

From the above, it can be understood that the image density can be kept constant by employing the liquid developer, the concentrated liquid and the diluent configured such that the liquid component of the concentrated liquid and the diluent have the charge director concentration and the charge amount per unit volume, which are substantially equal to those of the liquid component of the liquid developer, respectively.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid developer set formed of a liquid developer used for development of an electrostatic latent image as well as a concentrated liquid developer and a diluent to be supplied to the liquid developer, and comprising:

the liquid developer for development containing a carrier liquid, a charge director and toner, and a first liquid which is obtained by removing the toner from said liquid developer, wherein the first liquid has a charge director concentration C1 and a conductivity E1;

the concentrated liquid developer containing the carrier liquid, the charge director and the toner in a higher concentration than the toner concentration of the liquid developer, and a second liquid which is obtained by removing the toner from said concentrated liquid developer, wherein the second liquid has a charge director concentration C2 and a conductivity E2 substantially equal to the charge director concentration C1 and the conductivity E1 of said first liquid, respectively; and the diluent containing the carrier liquid and the charge director, and having a charge director concentration C3 and a conductivity E3 substantially equal to the charge director concentration C1 and the conductivity E1 of said first liquid, respectively.

2. The liquid developer set according to claim 1, wherein said charge director concentration C1 is equal to or differs by ±10% or less from an average value of said charge director concentration C1, said charge director concentration C2 and said charge director concentration C3, and said conductivity E1 is equal to or differs by ±10% or less from an average value of said conductivity E1, said conductivity E2 and said conductivity E3.

3. The liquid developer set according to claim 1, wherein said toner has a volume average particle diameter in a range from 0.1 $\mu$m to 10 $\mu$m.

4. The liquid developer set according to claim 1, wherein said carrier liquid has an electric resistance value in a range from $10^{11}$ Ω·cm to $10^{16}$ Ω·cm.

5. The liquid developer set according to claim 1, wherein said diluent is said second liquid obtained by removing the toner from said concentrated liquid developer, and said liquid developer for development is prepared by diluting said concentrated liquid developer with said second liquid.

6. The liquid developer set according to claim 1, wherein said diluent is formed of a third liquid prepared by applying a predetermined stress to the carrier liquid having the substantially same charge director concentration as said second liquid obtained by removing the toner from said concentrated liquid developer, and thereby having the substantially same conductivity as said second liquid, and said liquid developer for development is prepared by diluting said concentrated liquid developer with said third liquid.

7. A concentrated liquid developer to be supplied to a liquid developer used for development of an electrostatic latent image and containing a carrier liquid, a charge director and toner, wherein said concentrated liquid developer comprises:

the carrier liquid, the charge director and the toner in a higher concentration than that of the toner in the liquid developer for development, a second liquid, which is prepared by removing the toner from the concentrated liquid developer, wherein the second liquid has a charge director concentration C2 and a conductivity E2 substantially equal to a charge director concentration C1 and a conductivity E1 of a first liquid obtained by removing the toner from said liquid developer for development.

8. The concentrated liquid developer according to claim 7, wherein said charge director concentration C1 is equal to or differs by ±10% or less from an average value of said charge director concentration C1 and said charge director concentration C2, and said conductivity E1 is equal to or differs by ±10% or less from an average value of said conductivity E1 and said conductivity E2.

9. The concentrated liquid developer according to claim 7, wherein said toner has a volume average particle diameter in a range from 0.1 $\mu$m to 10 $\mu$m.

10. The concentrated liquid developer according to claim 7, wherein said carrier liquid has an electric resistance value in a range from $10^{11}$ Ω·cm to $10^{16}$ Ω·cm.

11. A diluent to be supplied to a liquid developer used for development of an electrostatic latent image and containing a carrier liquid, a charge director and toner, wherein the diluent comprises:

the carrier liquid and the charge director, and has a charge director concentration C3 and a conductivity E3 substantially equal to a charge director concentration C1 and a conductivity E1 of a first liquid obtained by removing the toner from said liquid developer for development, respectively.

12. The diluent according to claim 11, wherein said charge director concentration C1 is equal to or differs by ±10% or less from an average value of said charge director concentration C1 and said charge director concentration C3, and said conductivity E1 is equal to or differs by ±10% or less from an average value of said conductivity E1 and said conductivity E3.

13. The diluent according to claim 11, wherein said toner of said liquid developer for development has a volume average particle diameter in a range from 0.1 $\mu$m to 10 $\mu$m.

14. The diluent according to claim 11, wherein said carrier liquid has an electric resistance value in a range from $10^{11}$ Ω·cm to $10^{16}$ Ω·cm.

15. The diluent according to claim 11, wherein said diluent is the first liquid obtained by removing the toner from said liquid developer for development.

16. The diluent according to claim 11, wherein said diluent is a liquid obtained by preparing a carrier liquid having a charge director concentration substantially equal to that of said first liquid obtained by removing the toner from said liquid developer for development, wherein a conductivity of said carrier liquid is adjusted to be substantially equal to that of said first liquid by applying a predetermined stress to the carrier liquid, and said liquid developer for development is prepared by diluting a concentrated liquid developer containing the carrier liquid, the charge director and toner in a higher concentration than the toner concentration of said liquid developer with said diluent.

17. A method of manufacturing a diluent to be supplied to a liquid developer used for development of an electrostatic latent image and containing a carrier liquid, a charge director and toner, wherein the method of manufacturing the diluent comprises:

preparing a toner-dispersed liquid containing the carrier liquid, the charge director and the toner; and removing the toner from said toner-dispersed liquid to form the diluent.

18. The method of manufacturing the diluent according to claim 17, wherein said toner-dispersed liquid is a concentrated liquid developer used as a supply liquid for the liquid developer for development.

19. A method of manufacturing a diluent to be supplied to a liquid developer used for development of an electrostatic latent image and containing a carrier liquid, a charge director and toner, wherein the method of manufacturing the diluent comprises:

preparing a second carrier liquid having a second charge director concentration substantially equal to that of a first liquid obtained by removing the toner from said liquid developer for development; and adjusting a conductivity of said second carrier liquid to be substantially equal to that of said first liquid by applying a predetermined stress to said second carrier liquid.

20. A method of manufacturing a diluent to be supplied to a liquid developer used for development of an electrostatic latent image and containing a carrier liquid, a charge director and toner, wherein the method of manufacturing the diluent comprises:

preparing a second carrier liquid having a second charge director concentration substantially equal to that of a first liquid obtained by removing the toner from the liquid developer for development; and adjusting a conductivity of said second carrier liquid to be substantially equal to that of said first liquid by applying a shearing force to said second carrier liquid while mixing beads with said second carrier liquid.

* * * * *